US010551022B2

(12) United States Patent
Nakanishi

(10) Patent No.: US 10,551,022 B2
(45) Date of Patent: Feb. 4, 2020

(54) VEHICLE LAMP

(71) Applicant: Koito Manufacturing Co., Ltd., Tokyo (JP)

(72) Inventor: Yoshiyuki Nakanishi, Shizuoka (JP)

(73) Assignee: Koito Manufacturing Co., Ltd., Tokyo (JP)

( * ) Notice: Subject to any disclaimer, the term of this patent is extended or adjusted under 35 U.S.C. 154(b) by 0 days.

(21) Appl. No.: 16/253,368

(22) Filed: Jan. 22, 2019

(65) Prior Publication Data

US 2019/0234578 A1 Aug. 1, 2019

(30) Foreign Application Priority Data

Jan. 31, 2018 (JP) ..... 2018-014732

(51) Int. Cl.

| | |
|---|---|
| ***F21S 41/675*** | (2018.01) |
| ***F21S 41/43*** | (2018.01) |
| ***F21S 41/147*** | (2018.01) |
| ***F21S 41/689*** | (2018.01) |
| ***F21S 41/255*** | (2018.01) |
| ***F21S 41/32*** | (2018.01) |
| ***F21S 41/686*** | (2018.01) |

(52) U.S. Cl.

CPC ..... *F21S 41/675* (2018.01); *F21S 41/147* (2018.01); *F21S 41/255* (2018.01); *F21S 41/321* (2018.01); *F21S 41/43* (2018.01); *F21S 41/686* (2018.01); *F21S 41/689* (2018.01)

(58) Field of Classification Search

CPC ..... F21S 41/675; F21S 41/686; F21S 41/689; F21S 41/147; F21S 41/244; F21S 41/321; F21S 41/43; B60Q 1/04

See application file for complete search history.

(56) References Cited

U.S. PATENT DOCUMENTS

| | | | | |
|---|---|---|---|---|
| 10,208,911 | B2 * | 2/2019 | Tanaka | F21S 41/336 |
| 2005/0213340 | A1 * | 9/2005 | Suzuki | F21S 41/689 362/538 |
| 2013/0141928 | A1 * | 6/2013 | Puente | B60Q 1/0047 362/487 |
| 2019/0161005 | A1 * | 5/2019 | Yagi | F21S 41/322 |

FOREIGN PATENT DOCUMENTS

WO 2015/122304 A 8/2015

* cited by examiner

*Primary Examiner* — Alan B Cariaso
(74) *Attorney, Agent, or Firm* — Abelman, Frayne & Schwab

(57) ABSTRACT

A vehicle lamp includes a light source, a rotation reflector that includes a reflective surface that reflects emission light emitted from the light source while rotating, a projection lens that projects the reflected light from the rotation reflector to a front of the vehicle, and a movable shade provided between the rotation reflector and the projection lens. The movable shade is configured to be movable between a first position where the reflected light passes when the reflected light is projected to the front side of the vehicle and a second position where at least a part of incident light that is incident from the projection lens is shielded so as not to reach the rotation reflector.

9 Claims, 9 Drawing Sheets

20

20

20

20

VEHICLE LAMP

CROSS-REFERENCE TO RELATED APPLICATIONS

This application is based on and claims priority from Japanese Patent Application No. 2018-014732, filed on Jan. 31, 2018 with the Japan Patent Office, the disclosure of which is incorporated herein in its entirety by reference.

TECHNICAL FIELD

The present disclosure relates to a vehicle lamp.

BACKGROUND

In recent years, an apparatus has been devised that reflects light emitted from a light source to the front of a vehicle and forms a predetermined light distribution pattern by scanning the front region of the vehicle with the reflected light. For example, an apparatus includes a rotation reflector that rotates in a direction around a rotation shaft while reflecting light emitted from a light source, and a light source that is formed of a light emitting element. The rotation reflector is provided with a reflective surface so that the light from the light source that is reflected while rotating forms a desired light distribution pattern. Further, the light from the light source reflected by the reflective surface is projected to the front side through a projection lens as a light source image (see, e.g., International Laid-open Patent No. WO 15/122304).

SUMMARY

In the above-described apparatus, when sunlight in the daytime is incident into the apparatus from the projection lens, the light may be converged on a part in the apparatus in some cases, thereby eroding the part. Therefore, in the above-described apparatus, a shade is provided between the projection lens and the rotation reflector so as not to converge sunlight on a blade surface of the rotation reflector.

However, since the above-described shade is a fixed type, a region on the reflective surface of the blade, which is necessary for reflecting the light emitted from the light source toward the projection lens to form a desired light distribution pattern, is always exposed. Further, when the shade is made too large, it may hinder the formation of a desired light distribution pattern. Therefore, the blade surface may be burned depending on the angle of the sunlight that is incident on the projection lens.

The present disclosure has been made in view of such circumstances, and provides a novel optical unit that suppresses erosion due to convergence of sunlight from occurring without significantly degrading light distribution performance.

In order to solve the above problem, a vehicle lamp according to an aspect of the present disclosure includes: a light source; a rotation reflector that includes a reflective surface configured to reflect emission light emitted from the light source while rotating; a projection lens that projects the reflected light from the rotation reflector to a front side of the vehicle; and a movable shade provided between the rotation reflector and the projection lens. The movable shade is configured to be movable between a first position where the reflected light passes when the reflected light is projected to the front side of the vehicle and a second position where at least a part of incident light that is incident from the projection lens is shielded so as not to reach the rotation reflector.

According to the aspect, it is possible to prevent at least a part of incident light that is incident from the projection lens from reaching the rotation reflector by moving the movable shade to the second position. Therefore, for example, even in a situation where sunlight is incident into the apparatus from the projection lens like in the daytime, the sunlight may be hardly converged on a surface of the rotation reflector.

The movable shade may include an opening portion formed to direct the reflected light to the projection lens when located in the first position, and a shielding portion that shields the incident light such that at least a part of the incident light does not reach the rotation reflector when located in the second position.

The movable shade may be a rotation body having a rotation shaft on a same axis as the rotation reflector. Therefore, the movable shade may be rotated by a common driving source to the rotation reflector.

The vehicle lamp may further include: a moving mechanism that turns the movable shade toward the first position accompanying the rotation of the rotation reflector; a regulation mechanism that regulates the movable shade so as to stop the movable shade at the first position when the rotation reflector is rotating; and a restoring mechanism that turns the movable shade toward the second position when the rotation of the rotation reflector is stopped. Therefore, a driving source configured to move the movable shade between the first position and the second position may not be provided separately from the driving source that rotationally drives the rotation reflector.

The movable shade may be configured to reflect the emission light toward the projection lens when in the second position. Therefore, even when the rotation reflector is not rotating, the reflected light may be projected to the front of the vehicle.

Any combinations of the above components, and expressions of the present disclosure that are transformed among methods, apparatuses, systems, and the like are also effective as aspects of the present disclosure.

According to the present disclosure, occurrence of erosion due to convergence of sunlight may be suppressed.

The foregoing summary is illustrative only and is not intended to be in any way limiting. In addition to the illustrative aspects, embodiments, and features described above, further aspects, embodiments, and features will become apparent by reference to the drawings and the following detailed description.

DETAILED DESCRIPTION

In the following detailed description, reference is made to the accompanying drawing, which form a part hereof. The illustrative embodiments described in the detailed description, drawing, and claims are not meant to be limiting. Other embodiments may be utilized, and other changes may be made, without departing from the spirit or scope of the subject matter presented here.

Hereinafter, embodiments of the present disclosure will be described with reference to the drawings. Identical or corresponding components, members, and processes in each of the drawings will be denoted by the same symbols, and overlapping descriptions thereof will be appropriately omitted. Further, the embodiments are not intended to limit the present disclosure thereto, but are merely exemplary. All features described in the embodiments or combinations thereof may not be essential for the present disclosure.

First Embodiment

Figure 1:
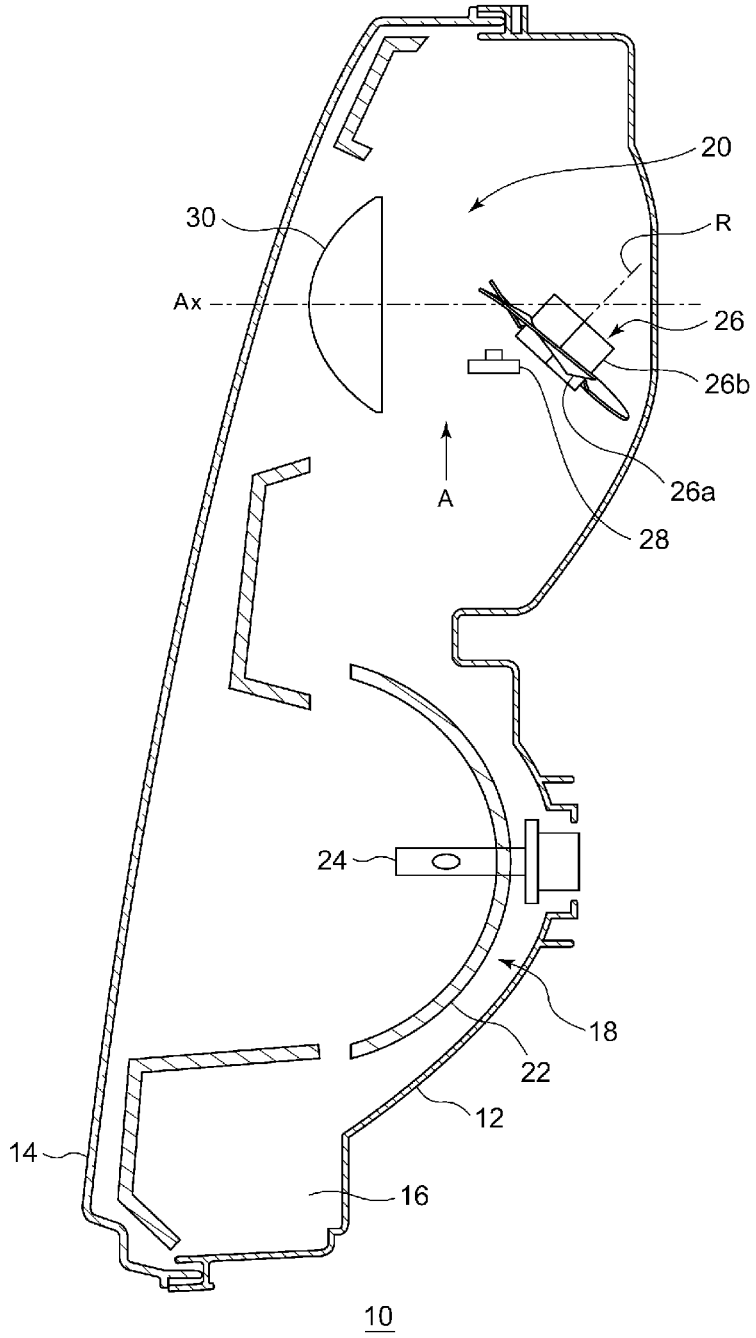
FIG. 1 is a horizontal sectional view of a vehicle headlamp according to a first embodiment.

FIG. 1 is a horizontal sectional view of a vehicle headlamp according to a first embodiment. A vehicle headlamp 10 is a right side headlamp mounted on a right side of the front end portion of a vehicle and has the same structure with a headlamp mounted on a left side except that they are laterally symmetrical with each other. Therefore, in the following, only the vehicle headlamp 10 on the right side will be described, and descriptions on the vehicle headlamp on the left side will be omitted.

As illustrated in FIG. 1, the vehicle headlamp 10 includes a lamp body 12 having a recess that is opened toward the front side. The lamp body 12 is covered with a front surface cover 14 whose front opening is transparent, so that a lamp chamber 16 is formed. The lamp chamber 16 functions as a space in which two lamp units 18 and 20 are accommodated in a state where they are arranged side by side in a vehicle width direction.

In the vehicle headlamp 10 on the outer side, that is, on the right side among the lamp units, the lamp unit 20 arranged on an upper side illustrated in FIG. 1 is a lamp unit including a lens and is configured to irradiate a variable high beam. In the vehicle headlamp 10 on the inner side, that is, on the right side among the lamp units, the lamp unit 18 arranged on a lower side illustrated in FIG. 1 is configured to irradiate a low beam.

The low beam lamp unit 18 includes a reflector 22, a light source valve (incandescent bulb) 24 supported by the reflector 22, and a shade (not illustrated). The reflector 22 is supported tiltably with respect to the lamp body 12 by any known means, for example, a means using an aiming screw and a nut.

As illustrated in FIG. 1, the lamp unit 20 includes a rotation reflector 26, an LED 28, and a convex lens 30 as a projection lens arranged in front of the rotation reflector 26. Instead of the LED 28, a semiconductor light emitting element such as an EL element or an LD element may be used as a light source. Further, instead of the LED 28, a semiconductor laser or a light source that excites and emits a phosphor with a semiconductor laser may be used, or a combination of these and an LED may be used as a light source. In particular, for control for shielding a part of a light distribution pattern (will be described later), a light source able to be turned ON/OFF with high accuracy in a short time may be used. A shape of the convex lens 30 may be appropriately selected according to light distribution characteristics such as a required light distribution pattern or illuminance distribution. An aspheric lens or a free curved surface lens may be used. In the present embodiment, an aspheric lens is used as the convex lens 30.

The rotation reflector 26 is rotated in one direction around a rotation axis R by a driving source such as a motor (not illustrated). Further, the rotation reflector 26 includes a reflective surface that reflects light emitted from the LED 28 while rotating so as to form a desired light distribution pattern. In the embodiment, the rotation reflector 26 constitutes an optical unit.

Figure 2:
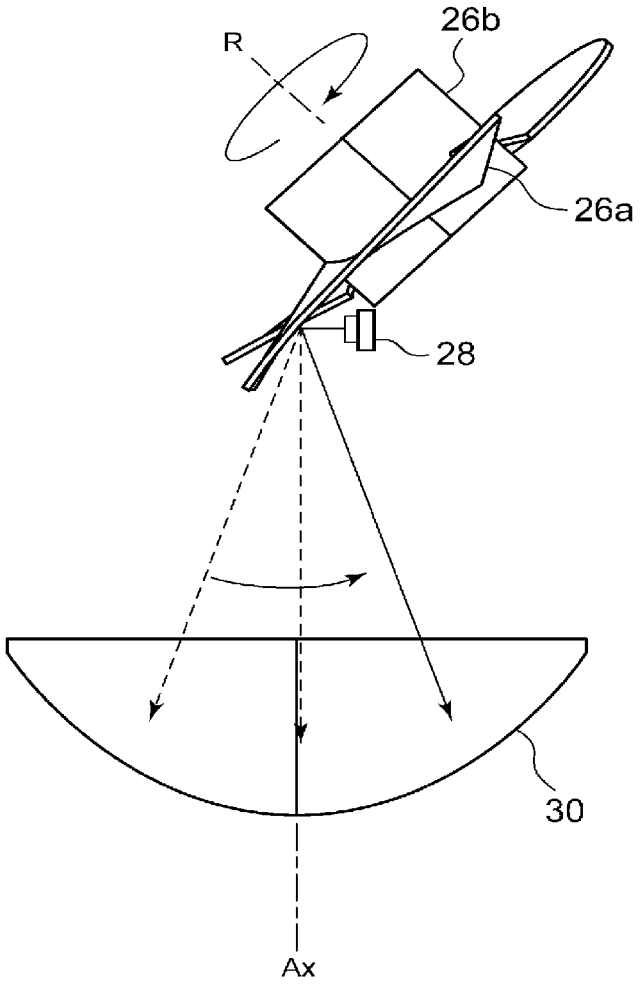
FIG. 2 is a plan view schematically illustrating a configuration of a lamp unit including an optical unit according to the present embodiment.
Figure 3:
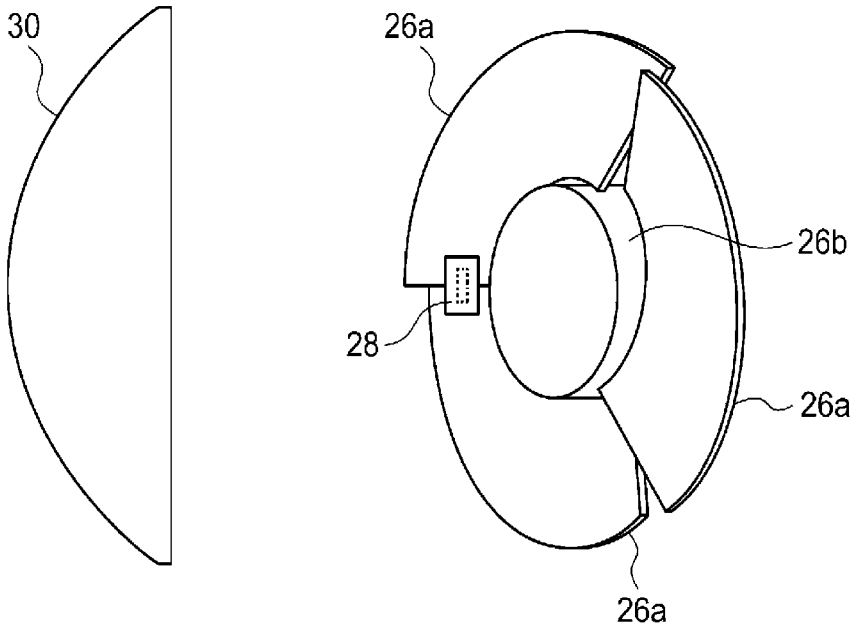
FIG. 3 is a side view of the lamp unit when viewed from a direction A illustrated in FIG. 1.

FIG. 2 is a plan view schematically illustrating a configuration of the lamp unit 20 including an optical unit according to the present embodiment. FIG. 3 is a side view of the lamp unit 20 when viewed from a direction A illustrated in FIG. 1.

In the rotation reflector 26, three blades 26*a* having the same shape and serving as reflective surfaces are provided around a tubular rotation portion 26*b*. The rotation axis R is inclined with respect to an optical axis Ax and is provided in a plane including the optical axis Ax and the LED 28. In other words, the rotation axis R is provided substantially in parallel with a scanning plane of the light (irradiation beam) of the LED 28 which scans in the lateral direction by rotation. In this way, the optical unit may become thin. Here, the scanning plane may be understood as a fan-shaped plane formed by, for example, continuously connecting traces of light of the LED 28 that is the scanning light. Further, in the lamp unit 20 according to the present embodiment, the provided LED 28 is relatively small, and a position where the LED 28 is arranged is between the rotation reflector 26 and the convex lens 30 and derived from the optical axis Ax. Therefore, as compared with a case where a light source, a reflector, and a lens are arranged in a row on an optical axis, like a projector type lamp unit in the related art, a depth direction (the front-rear direction of the vehicle) of the vehicle headlamp 10 may be shortened.

Further, the shape of the blade 26*a* of the rotation reflector 26 is configured so that a secondary light source of the LED 28 due to reflection is formed near a focal point of the convex lens 30. Further, the blade 26*a* has a twisted shape so that an angle formed between the optical axis Ax and the reflective surface changes along a circumferential direction around the rotation axis. Therefore, as illustrated in FIG. 2, scanning using the light of the LED 28 becomes possible. This will be described in more detail.

The number or the shape of blades 26*a*, and a rotational speed of the rotation reflector 26 are appropriately set based on results of experiments and simulations taking account on characteristics of the required light distribution pattern or flicker of a scanned image. Further, a motor may be used as a drive unit capable of changing the rotational speed according to various light distribution controls. Therefore, the scanning timing may be easily changed. As such a motor, the motor may be capable of obtaining rotation timing information from the motor itself. Specifically, a DC brushless motor may be used. When the DC brushless motor is used, since the rotation timing information may be obtained from the motor itself, devices such as an encoder may be omitted.

As described above, by figuring out the shape or the rotational speed of the blade 26*a*, the rotation reflector 26 according to the present embodiment may scan the front of the vehicle in the lateral direction using the emission light of the LED 28 reflected by the rotation reflector 26. Specifically, when the rotation reflector 26 is rotating, the reflective surface is configured such that the reflection direction of the emission light is periodically changed.

The vehicle headlamp 10 according to the present embodiment reflects the light of the LED 28 by the rotation reflector 26 and scans the front with the reflected light, so that a high beam light distribution pattern substantially rectangular may be formed. As described above, the desired light distribution pattern may be formed with rotation of the rotation reflector in one direction. Therefore, it is unnecessary to drive a special mechanism such as a resonance mirror, and as for the resonance mirror, restrictions on the size of the reflective surface are small. Therefore, by selecting the rotation reflector 26 having a larger reflective surface, the light emitted from the light source may be used efficiently as an illumination. That is, the maximum light intensity in the light distribution pattern may be increased. The rotation reflector 26 according to the present embodiment has a diameter substantially the same as that of the convex lens 30, and according to this, an area of the blade 26*a* may be increased.

Further, the vehicle headlamp 10 including the optical unit according to the present embodiment may form a high beam light distribution pattern in which an arbitrary region is shielded, by synchronizing the timing of turning ON/OFF or the change in emission light intensity of the LED 28 with the rotation of the rotation reflector 26. Further, when the high beam light distribution pattern is formed by changing (turning ON/OFF) emission light intensity of the LED 28 by synchronizing with the rotation of the rotation reflector 26, it is possible to control to swivel the light distribution pattern itself by shifting a phase of the change of the light intensity.

As described above, the vehicle headlamp according to the present embodiment may form a light distribution pattern by scanning the light of the LED, and arbitrarily form a shielding portion on a part of the light distribution pattern by controlling the change in the emission light intensity. Therefore, as compared with a case where a shielding portion is formed by turning OFF some of a plurality of LEDs, it is possible to shield the desired region precisely with a small number of LEDs. Further, the vehicle headlamp 10 may form a plurality of shielding portions. Therefore, when a plurality of vehicles are present in the front, it is possible to shield regions that correspond to each of the vehicles.

In addition, since the vehicle headlamp 10 may control the shielding without moving the basic light distribution pattern, it is possible to reduce discomfort given to a driver during shielding control. Further, since the light distribution pattern may be swiveled without moving the lamp unit 20, the mechanism of the lamp unit 20 may be simplified. Therefore, as a drive unit for the variable light distribution control, the vehicle headlamp 10 is only required to have a motor necessary for the rotation of the rotation reflector 26, so that simplification of the configuration, cost reduction, and miniaturization are promoted.

Figure 4:
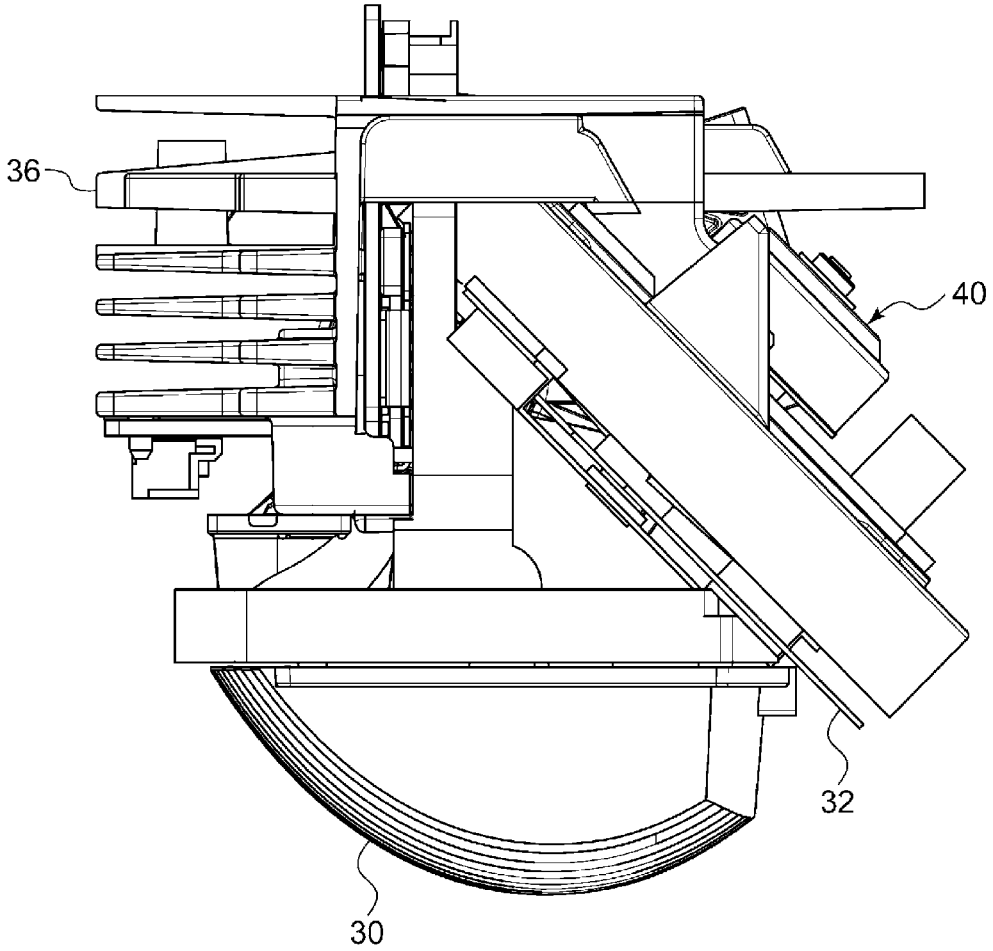
FIG. 4 is a plan view of the lamp unit according to the present embodiment.
Figure 5:
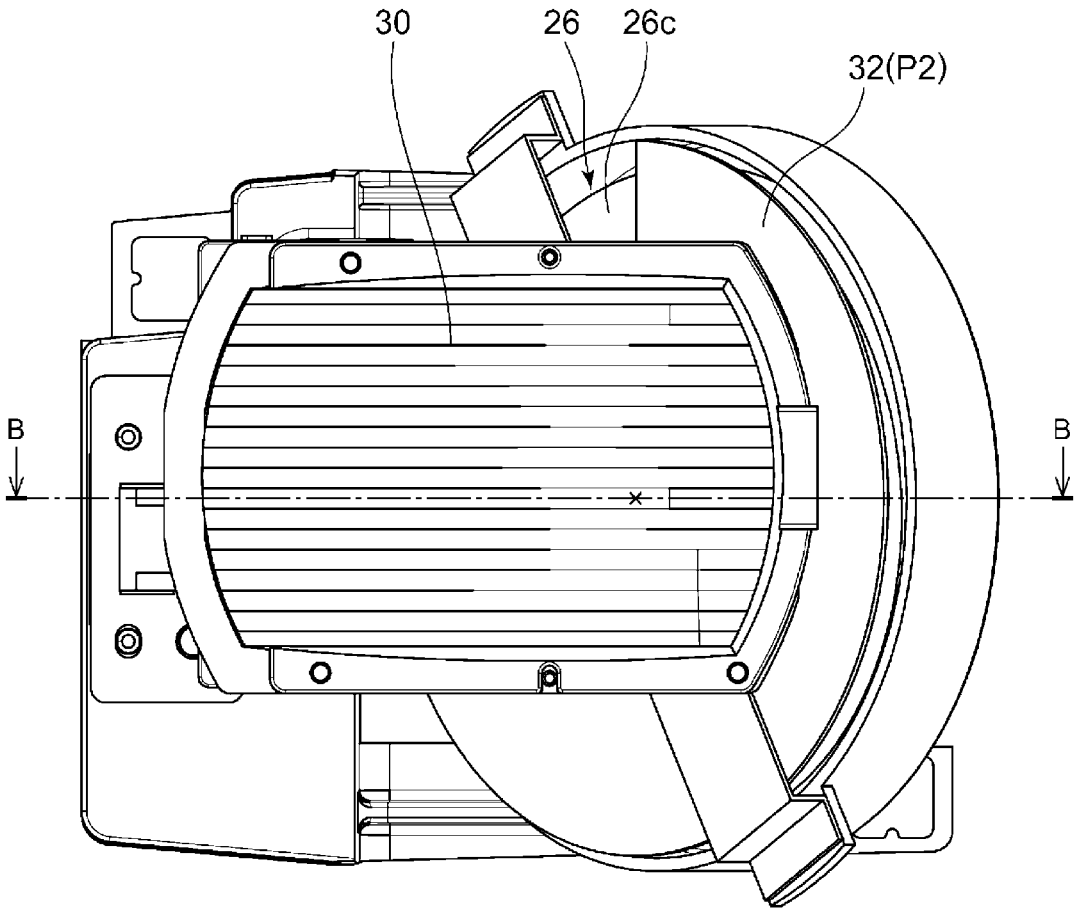
FIG. 5 is a front view of the lamp unit according to the present embodiment.
Figure 6:
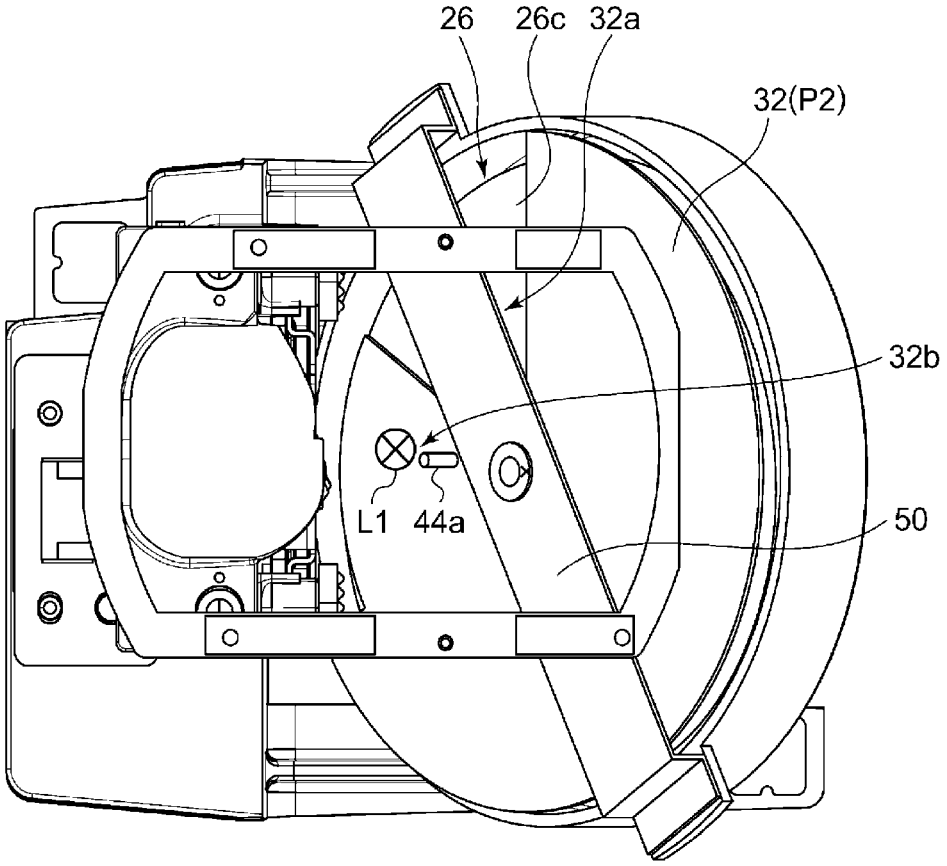
FIG. 6 is a front view in which a convex lens of the lamp unit illustrated in FIG. 5 is omitted.
Figure 7:
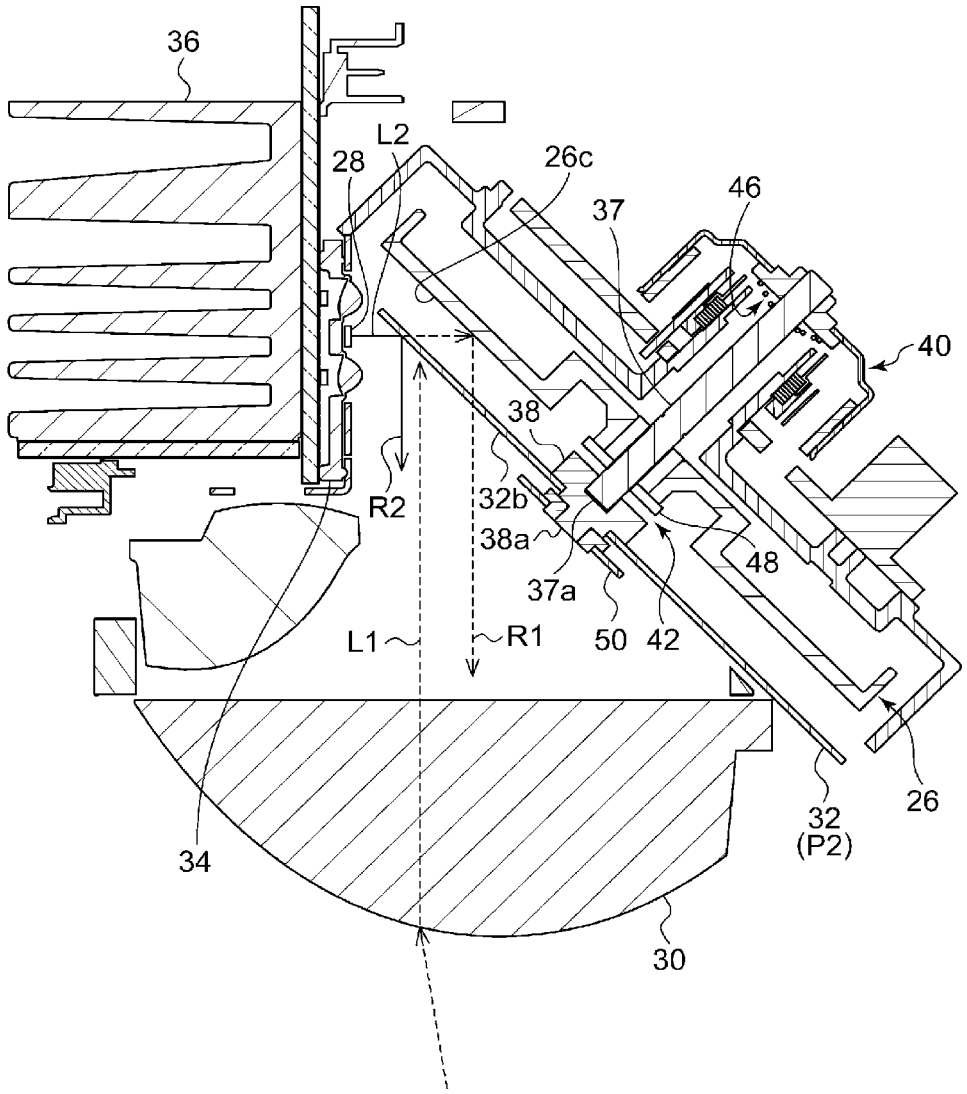
FIG. 7 is a cross-sectional view taken along the line B-B of the lamp unit illustrated in FIG. 5.
Figure 8:
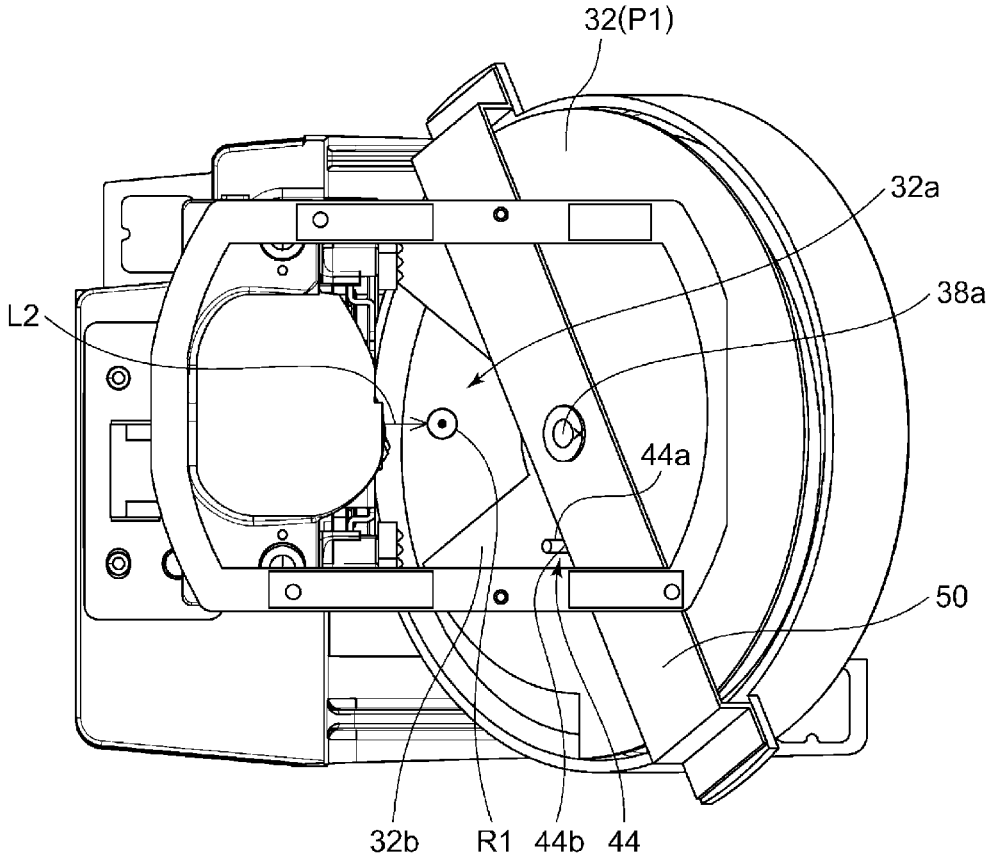
FIG. 8 is a front view illustrating a state where a movable shade is in a position different from a position of the movable shade illustrated in FIG. 6.

Next, the structure of the lamp unit 20 as the vehicle lamp according to the present embodiment will be further described. FIG. 4 is a plan view of the lamp unit 20 according to the present embodiment. FIG. 5 is a front view of the lamp unit 20 according to the present embodiment. FIG. 6 is a front view in which the convex lens 30 of the lamp unit 20 illustrated in FIG. 5 is omitted. FIG. 7 is a cross-sectional view taken along the line B-B of the lamp unit 20 illustrated in FIG. 5. FIG. 8 is a front view illustrating a state where a movable shade is in a position different from a position of the movable shade illustrated in FIG. 6.

The lamp unit 20 illustrated in FIGS. 4 to 7 includes the LED 28 as a light source, the rotation reflector 26 having a reflective surface 26*c* that reflects emission light emitted from the LED 28 while rotating, the convex lens 30 as a projection lens that projects the reflected light reflected by the rotation reflector 26 to the front of the vehicle, and a movable shade 32 provided between the rotation reflector 26 and the convex lens 30. The movable shade 32 is configured to be movable between a first position P1 (see, e.g., FIG. 8) where the reflected light passes when the reflected light is projected to the front of the vehicle and a second position (P2) (see, e.g., FIG. 6) where at least a part of incident light that is incident from the convex lens 30 is shielded so as not to reach the rotation reflector 26. The LED 28 is fixed to a heat sink 36 in a state of being mounted on an element mounting substrate 34.

As illustrated in FIG. 5 or FIG. 7, the lamp unit 20 according to the present embodiment may be shielded so that at least a part of the incident light L1 that is incident from the convex lens 30 does not reach the rotation reflector 26, with the movable shade 32 moving to the second position P2. The movable shade 32 may shield so that the incident light L1 does not reach the reflective region of the rotation reflector 26 that reflects the emission light of the LED 28. Therefore, for example, even in a situation where sunlight is incident into the apparatus from the convex lens 30 like in the daytime, it is possible for the sunlight to hardly converge on a surface of the rotation reflector 26. Therefore, occurrence of erosion due to convergence of sunlight may be suppressed.

The movable shade 32 includes a an opening portion 32*a* that is formed to direct the reflected light R1 of the emission light L2 emitted from the LED 28 when located in the first position P1 illustrated in FIG. 8, and a shielding portion 32*b* that shields so that at least a part of the incident light L1 such as sunlight that is incident from the outside to the lamp does not reach the rotation reflector 26 when in the second position P2 illustrated in FIG. 6.

The movable shade 32 is provided with the shielding portion 32*b* having an arc shape. Therefore, the movable shade 32 may be embodied as a similar shape to the rotation reflector 26, so that a space for providing the movable shade 32 may be suppressed. Further, the movable shade 32 may be a circular plate member in which a part of the region is transparent instead of providing the opening portion 32*a*.

Further, the movable shade 32 is configured so that the position of the opening portion (see, e.g., FIG. 6) when located in the second position P2 is higher than the position (see, e.g., FIG. 8) of the opening portion 32*a* when in the first position P1. Therefore, for example, even in a situation where sunlight is incident from obliquely above through the convex lens 30 into the apparatus, the incident light L1 hardly reaches the surface of the rotation reflector 26 from the opening portion 32*a* moving above the center of the convex lens 30.

The movable shade 32 according to the present embodiment is a rotation body having a rotation shaft 38 provided coaxial with a rotation shaft 37 of the rotation reflector 26. Therefore, the movable shade 32 may be rotated by a motor 40 that is a common driving source to the rotation reflector 26.

Further, the lamp unit 20 includes a moving mechanism 42 that turns the movable shade 32 toward the first position P1 accompanying the rotation of the rotation reflector 26, a regulation mechanism 44 that regulates the movable shade 32 to stop at the first position P1 when the rotation reflector 26 is rotating, and a restoring mechanism 46 that turns the movable shade 32 toward the second position P2 when the rotation of the rotation reflector 26 is stopped.

The moving mechanism 42 according to the present embodiment has the rotation shaft 38 of the movable shade 32 and a ring-shaped magnet 48 that fixes the rotation reflector 26 so as not to come out from the rotation shaft 37. At least a portion of the rotation shaft 38 that faces the magnet 48 is made of a magnetic material. Further, the rotation shaft 38 of the movable shade 32 is supported by a distal end portion 37*a* of the rotation shaft 37 so as to be slidable (relatively rotatable) with respect to the rotation shaft 37 of the rotation reflector 26. Therefore, when the rotation reflector 26 begins to rotate, the magnet 48 on the distal end portion of the rotation shaft 37 to which the rotation reflector 26 is fixed generates a force that rotates the rotation shaft 38 due to magnetic attraction force, so that the movable shade 32 rotates together with the rotation reflector 26. It may be possible to configure to move the position of the movable shade 32 not by magnetic power, but by, for example, wind pressure.

The regulation mechanism 44 according to the present embodiment is configured so that a locking portion (convex portion 44*a*) of a part of the movable shade 32 that rotates together with the rotation of the rotation reflector 26 is brought into contact with a portion 44*b* to be locked provided on a part of a component (supporting member 50) that constitutes the lamp unit 20 so as to regulate further rotation of the movable shade 32. Therefore, while the rotation reflector 26 is rotating, it is possible to hold the movable shade 32 at the first position P1.

The restoring mechanism 46 according to the present embodiment is, for example, a torsion spring provided between the supporting member 50 (see, e.g., FIG. 6 or FIG. 8) that rotatably supports a convex portion 38*a* of the distal end portion of the rotation shaft 38 and the rotation shaft 38 of the movable shade 32. Therefore, when the rotation of the rotation reflector 26 is stopped, the movable shade 32 may be turned toward the second position P2 by an action of the torsion spring.

As described above, in the lamp unit 20 according to the present embodiment, a drive source for moving the movable shade 32 between the first position P1 and the second position P2 may not be provided separately from the motor that rotatably drives the rotation reflector 26. An actuator that moves the movable shade 32 between the first position P1 and the second position P2 may be provided separately from the motor.

Next, variations of the movable shade will be described. For example, in a situation in which the lamp unit 20 momentarily irradiates high beam (so called, passing beam irradiation) while traveling with only the lamp unit 18 that irradiates low beam being turned ON, in a case of a scanning optical system that uses the rotation reflector 26 such as the lamp unit 20 according to the present embodiment, a certain amount of time is required until the rotation speed of the rotation reflector 26 rises to a desired rotation speed. Therefore, even when a driver tries to momentarily irradiate high beam, the timing may be delayed.

Therefore, when located in the second position P2 as illustrated in FIG. 6 or FIG. 7, the shielding portion 32*b* of the movable shade 32 according to the present embodiment is configured to reflect the emission light L2 as a reflected light R2 toward the convex lens 30. For example, the surface of the movable shade may be a mirror-surface by vapor deposition or the like. Therefore, even when the rotation reflector 26 is not sufficiently rotating, the reflected light R2 may be projected to the front of the vehicle. Further, the surface of the shielding portion 32*b* may be formed so that the reflected light R2 is able to form a light distribution pattern that irradiates a forward vehicle in front of the vehicle.

Figure 9:
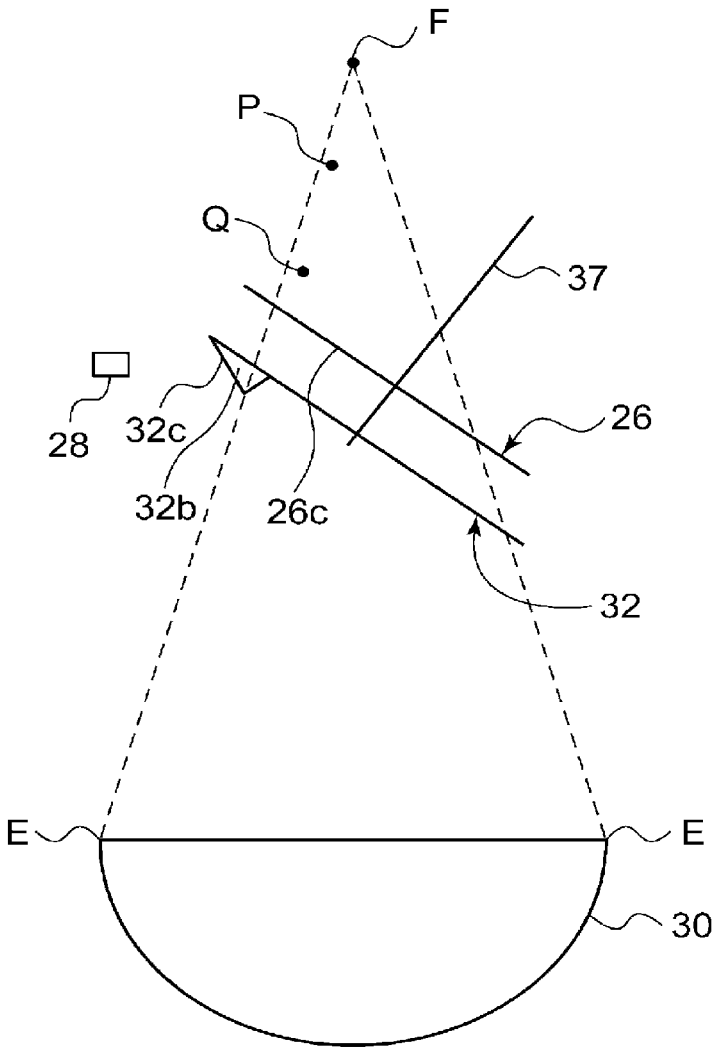
FIG. 9 is a schematic view for explaining another embodiment of a reflective surface of a shielding portion.

Further, as illustrated in FIGS. 4 to 9, the reflective surface of the shielding portion 32*b* of the movable shade 32 is a vertical plane with respect to the rotation shaft 37, but the present disclosure is not limited thereto. For example, the reflective surface of the shielding portion 32*b* may be configured to be capable of projecting a wider range in front of the vehicle with the reflected light R2 described above. FIG. 9 is a schematic view for describing another embodiment of a reflective surface of a shielding portion.

The reference symbol F illustrated in FIG. 9 is a focal point of the convex lens 30. The reference symbol P is a symmetrical point with respect to the LED 28 with the reflective surface 26*c* of the rotation reflector 26 as a symmetry plane. The reference symbol Q is a symmetrical point with respect to the LED 28 with the reflective surface 32*c* of the shielding portion 32*b* of the movable shade 32 as a symmetry plane. The reflective surface 26*c* is a symmetry plane in a case where the reflective surface is a vertical surface with respect to the rotation shaft 37.

The reflective surface 32*c* of the shielding portion 32*b* illustrated in FIG. 9 is provided on the movable shade 32 so that the symmetrical point Q is farther from the focal point F than the symmetrical point P. Further, configurations (position or an inclination of surfaces) of the LED 28, the rotation reflector 26, the movable shade 32, or the like are set so that both of the symmetrical points Q and P are positioned in a region made by connecting the focal point F and edges E of the convex lens 30.

A light image of the light of the LED 28 reflected by the reflective surface 32*c* having the symmetrical point Q set in this way becomes larger than a light image of the light of LED 28 reflected by the reflective surface 26*c* having the symmetrical point P. That is, since the irradiation range of the passing beam irradiation expands in front of the lamp, the visibility of the vehicle is enhanced. The reflective surface 32*c* may be a diffusive surface. The diffusive surface is a surface with micro unevenness which is not a mirror-surface, and is a surface that reflects incident light at various angles. Therefore, since the irradiation range of the passing beam irradiation further expands in front of the lamp, the visibility of the vehicle is enhanced.

From the foregoing, it will be appreciated that various exemplary embodiments of the present disclosure have been described herein for purposes of illustration, and that various modifications may be made without departing from the scope and spirit of the present disclosure. Accordingly, the various exemplary embodiments disclosed herein are not intended to be limiting, with the true scope and spirit being indicated by the following claims.

What is claimed is:

1. A vehicle lamp comprising:

a light source;

a rotation reflector that includes a reflective surface configured to reflect emission light emitted from the light source while rotating;

a projection lens that projects the reflected light from the rotation reflector to a front side of the vehicle; and a movable shade provided between the rotation reflector and the projection lens, wherein the movable shade is configured to be movable between a first position where the reflected light passes when the reflected light is projected to the front side of the vehicle and a second position where at least a part of incident light that is incident from the projection lens is shielded so as not to reach the rotation reflector.

2. The vehicle lamp of claim 1, wherein the movable shade includes an opening portion formed to direct the reflected light to the projection lens when located in the first position, and a shielding portion that shields the incident light such that at least a part of the incident light does not reach the rotation reflector when in the second position.

3. The vehicle lamp of claim 1, wherein the movable shade is a rotation body that includes a rotation shaft on a same axis as the rotation reflector.

4. The vehicle lamp of claim 2, wherein the movable shade is a rotation body including a rotation shaft on a same axis as the rotation reflector.

5. The vehicle lamp of claim 1, further comprising:

a moving mechanism that turns the movable shade toward the first position accompanying the rotation of the rotation reflector;

a regulation mechanism that regulates the movable shade so as to stop the movable shade at the first position when the rotation reflector is rotating; and a restoring mechanism that turns the movable shade toward the second position when the rotation of the rotation reflector is stopped.

6. The vehicle lamp of claim 2, further comprising:

a moving mechanism that turns the movable shade to the first position accompanying the rotation of the rotation reflector;

a regulation mechanism that regulates the movable shade so as to stop the movable shade at the first position when the rotation reflector is rotating; and a restoring mechanism that turns the movable shade toward the second position when the rotation of the rotation reflector is stopped.

7. The vehicle lamp of claim 3, further comprising:

a moving mechanism that turns the movable shade to the first position accompanying the rotation of the rotation reflector;

a regulation mechanism that regulates the movable shade so as to stop the movable shade at the first position when the rotation reflector is rotating; and a restoring mechanism that turns the movable shade toward the second position when the rotation of the rotation reflector is stopped.

8. The vehicle lamp of claim 4, further comprising:

a moving mechanism that turns the movable shade to the first position accompanying the rotation of the rotation reflector;

a regulation mechanism that regulates the movable shade so as to stop the movable shade at the first position when the rotation reflector is rotating; and a restoring mechanism that turns the movable shade toward the second position when the rotation of the rotation reflector is stopped.

9. The vehicle lamp of claim 1, wherein the movable shade is configured to reflect the emission light toward the projection lens when located in the second position.

* * * * *